United States Patent [19]

Ragueneau et al.

[11] Patent Number: 4,986,191

[45] Date of Patent: Jan. 22, 1991

[54] RAILWAY VEHICLE WHOSE WEIGHT IS DISTRIBUTED ON FOUR AXLES WHICH ARE STEERABLE RELATIVE TO THE BODY

[75] Inventors: Jean-Pierre Ragueneau, Guerard; Rene Klima, Athis Mons; Marie-Christine Piget, Paris, all of France

[73] Assignee: Regie Autonome Des Transports Parisiens, Paris Cedex, France

[21] Appl. No.: 409,013

[22] Filed: Sep. 18, 1989

Related U.S. Application Data

[63] Continuation of Ser. No. 143,806, Jan. 14, 1988, abandoned.

[30] Foreign Application Priority Data

Jan. 16, 1987 [FR] France ..... 87 00479

[51] Int. Cl.[5] ..... B61F 5/44

[52] U.S. Cl. ..... 105/168; 105/199.3

[58] Field of Search ..... 105/165, 168, 167, 3, 105/199.3, 199.1, 199.2, 176

[56] References Cited

U.S. PATENT DOCUMENTS

| | | | |
|---|---|---|---|
| 90,513 | 5/1869 | Eastman | 105/168 |
| 727,918 | 5/1903 | Ellery | 105/168 |
| 3,961,582 | 6/1976 | Paton et al. | 105/165 |
| 4,781,124 | 11/1988 | List | 105/168 |
| 4,802,418 | 2/1989 | Okamoto et al. | 105/167 |
| 4,819,566 | 4/1989 | Smith et al. | 105/163 |
| 4,823,706 | 4/1989 | McSweeney | 105/165 |

FOREIGN PATENT DOCUMENTS

| | | | |
|---|---|---|---|
| 647102 | 6/1937 | Fed. Rep. of Germany | 105/168 |

*Primary Examiner*—Robert P. Olszewski
*Assistant Examiner*—Mark T. Le
*Attorney, Agent, or Firm*—Bachman & LaPointe

[57] ABSTRACT

The invention relates to a railway vehicle comprising two sets of two axles which are steerable relative to the body. The load of the body is applied in the vertical plane of each axle at two points adjacent to the wheels. The load of the body is applied through slide friction blocks. The invention concerns in particular railway vehicles wherein each axle is radially guided.

4 Claims, 5 Drawing Sheets

RAILWAY VEHICLE WHOSE WEIGHT IS DISTRIBUTED ON FOUR AXLES WHICH ARE STEERABLE RELATIVE TO THE BODY

This is a continuation of application Ser. No. 143,806 filed Jan. 11, 1988, now abandoned.

BACKGROUND OF THE INVENTION

This invention relates to a railway vehicle comprising two sets of two axles which are steerable relative to the body.

DESCRIPTION OF THE PRIOR ART

Railway carriages for passenger transport (railcars) almost always have two bogies each comprising two axles, the bogies pivoting relative to the body about a central pivot. In this case, the weight of the carriage is applied to the center of each bogie so that the load of the body of the carriage is in fact concentrated at two points and with a cantilever between the central load point and the ends of the bogie, since the load is transmitted from the central point to each axle.

Railway vehicles are also known which comprise only two axles which are radially guided, that is to say axles whose axis is steered so as to pass always through the instantaneous center of rotation of the track. The radial guidance has the advantage of eliminating squeal in curves, and circulatory wear of the rails. The use of radial axles disposed at the ends of the railway vehicles also enables the axles to be loaded directly, and not centrally as in the case of a bogie. The load is then distributed without cantilever. However, for heavy vehicles, it is essential to increase the number of wheels to stay within the maximum loads accepted by the infrastructures.

In French patent No. 795 148 a railway vehicle is described which comprises two sets each having two axles which are mounted in such a way as to be pivotable independently of each other so as to produce, for each two-axle set, permanent radial guidance of the two axles. In this case, the two-axle set forms a sort of variable geometry bogie and, as for an ordinary bogie, the load is applied to the center of each of the sets so that these railway vehicles present the disadvantages described above for carriages with bogies.

OBJECTS OF THE INVENTION

It is an object of the invention to overcome some or all of the above disadvantages.

More specifically, one object of the invention is to provide a railway vehicle comprising two-axle sets which are steerable relative to the body, in which the load of the body is borne by the rolling members without any problem of cantilevering and with capability of bearing a heavy body.

BRIEF DESCRIPTION OF THE INVENTION

The present invention provides a railway vehicle comprising a body and two two-axle sets which are steerable relative to the body, wherein the load of the body is applied in the vertical plane of each axle at two points adjacent to the wheels. In this way, the load is applied at four points for each of the two-axle sets, which eliminates practically the cantilever problems referred to above, both horizontally and vertically also, the axle load being reduced, for example 22.5 tons, heavier carriages can be supported.

The axle may be a spindle-axis bearing the two wheels on opposite sides of the railway vehicle alternatively, the axle may comprise a cross-member bearing the wheels at each end and disposed in a plane different from the horizontal plane of the wheel axis.

In a first embodiment, said cross-member is disposed above the wheel axis, which enables the distance between the base of the body and the axle to be reduced, raising the support points for the body.

In a second embodiment, the cross-member is disposed below the wheel axis which enables the body to be lowered and produce passenger carriages with two stories, for example.

The load of the body may be applied to each of the axles through a side friction block alternatively torsion springs or ball or roller-bearings may be used.

DESCRIPTION OF THE DRAWINGS

Other features and advantages of the invention will appear from the following description, given by way of example, with reference to the accompanying drawings, in which.

DESCRIPTION OF A PREFERRED EMBODIMENT OF THE INVENTION

Figure 1:
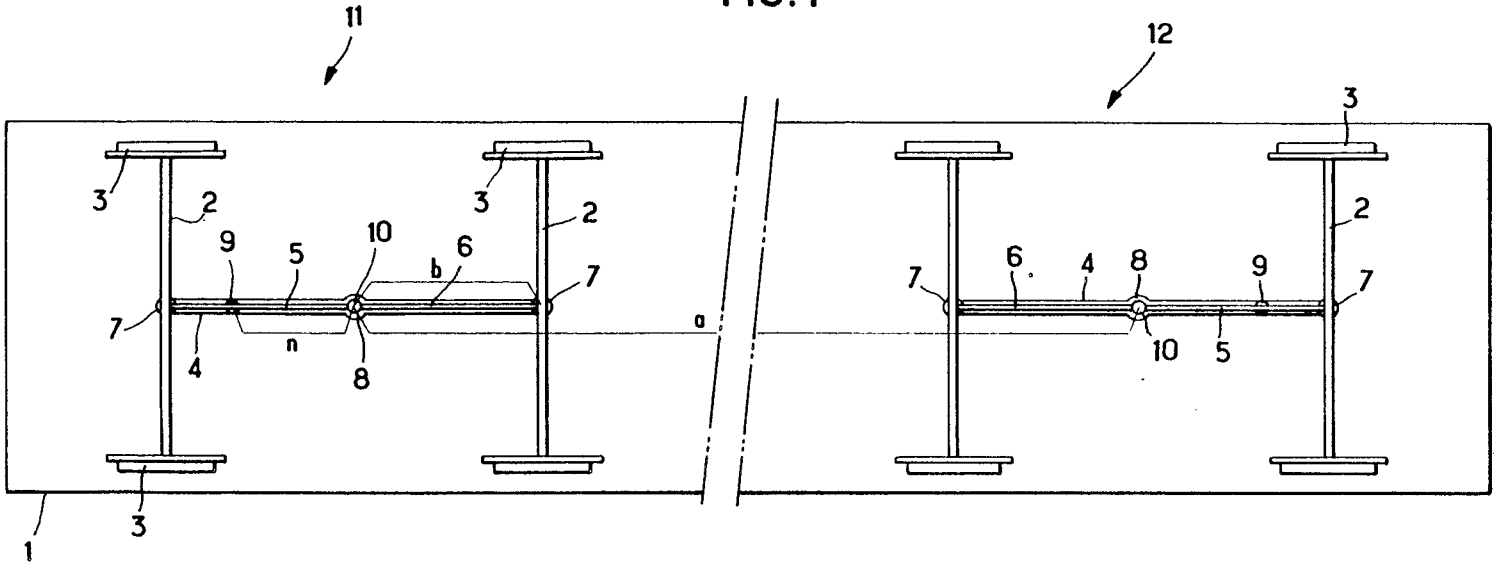
FIG. 1 is a diagrammatic plan view of a railway vehicle in accordance with an embodiment of the invention, of which the mid-part is not shown.
Figure 2:
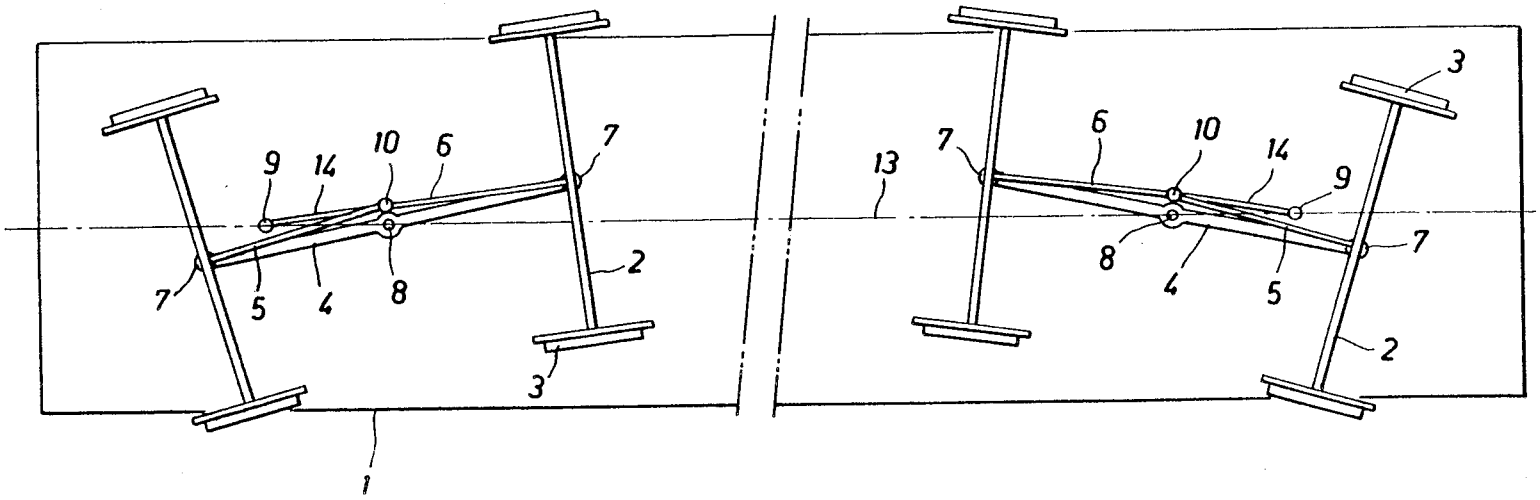
FIG. 2 is a view similar to FIG. 1 showing the vehicle in a curve, the radius of the curve having been substantially exaggerated for purposes of illustration.

FIGS. 1 and 2 show diagrammatically a railway vehicle comprising two sets each comprising two radially-guided axles. The center part of the vehicle is omitted from the drawings, for clarity. The vehicle comprises a body 1 supported by two sets 11 and 12 each of which comprises two axles 2 bearing wheels 3.

Each axle may be a spindle-axle solid with the wheels 3, but alternatively may comprise a cross-member disposed above the plane of the axis of the wheels 3 and bearing the wheels. The wheels may be independent or the cross-members may be fixed on assembled axles solid with the wheels 3. Each set 11 and 12 is disposed adjacent an end of the body 1.

For each set 11 or 12, the two axles 2 are connected together by a horizontal link bar 4 whose ends are mounted pivotingly at 7 to the middles of the axles or beams 2 and which is mounted pivotingly about a first vertical axis 8 solid with the body and disposed in the longitudinal mean plane 13 thereof.

Furthermore, each axle 2 comprises a steering bar which is fixed orthogonally to the axle at its midpoint 7. The first of the steering bars 5 has its free end fixed pivotingly on the second bar at a pivot point 10. The second bar 6 comprises an extension 14 projecting beyond the pivot point 10 with the first bar 5 and the free end of the extension 14 is fixed pivotingly about a second fixed vertical axis 9 solid with the body 1; this second fixed axis is also disposed in the longitudinal mean plane 13.

When the railway vehicle in accordance with this embodiment of the invention is on the straight, as shown in FIG. 1, the pivot axis 10 of the two steering bars 5 and 6 is juxtaposed with the first pivot axis 8 and the link bar 4 and the steering bars 5 and 6 are aligned. When the railway vehicle is on a curve, as shown in FIG. 2, the link bar 4 and the steering bars 5 and 6 are no longer aligned and the pivot point 10 of the two steering bars 5 and 6 is displaced towards the outside of the curve.

The second fixed vertical axis 9 may be located nearer the end of the wagon than the first vertical pivot axis 8 as in the embodiment illustrated; in a variant, the second fixed vertical axis 8 is located inside, that is to say nearer the center of the vehicle than the first vertical axis. In other words, in the first embodiment, the two second vertical axes are outside the two first vertical axes and in the second embodiment they are inside them.

To obtain axial guidance of each of the axles 2, each set 11 and 12 is arranged so that the distance (a) separating the two first axes of the two sets, the distance (b) on the straight between the center, 7 of an axle firstly fixed pivot axis 8, and the length (n) of the extension 14, that is to say the distance between the second fixed vertical axis 9 and the pivot point 10 of the two steering bars 5 and 6 are related at least approximately according to the following equation:

$$n = \frac{2b^2}{a - 2b}$$

Figure 3:
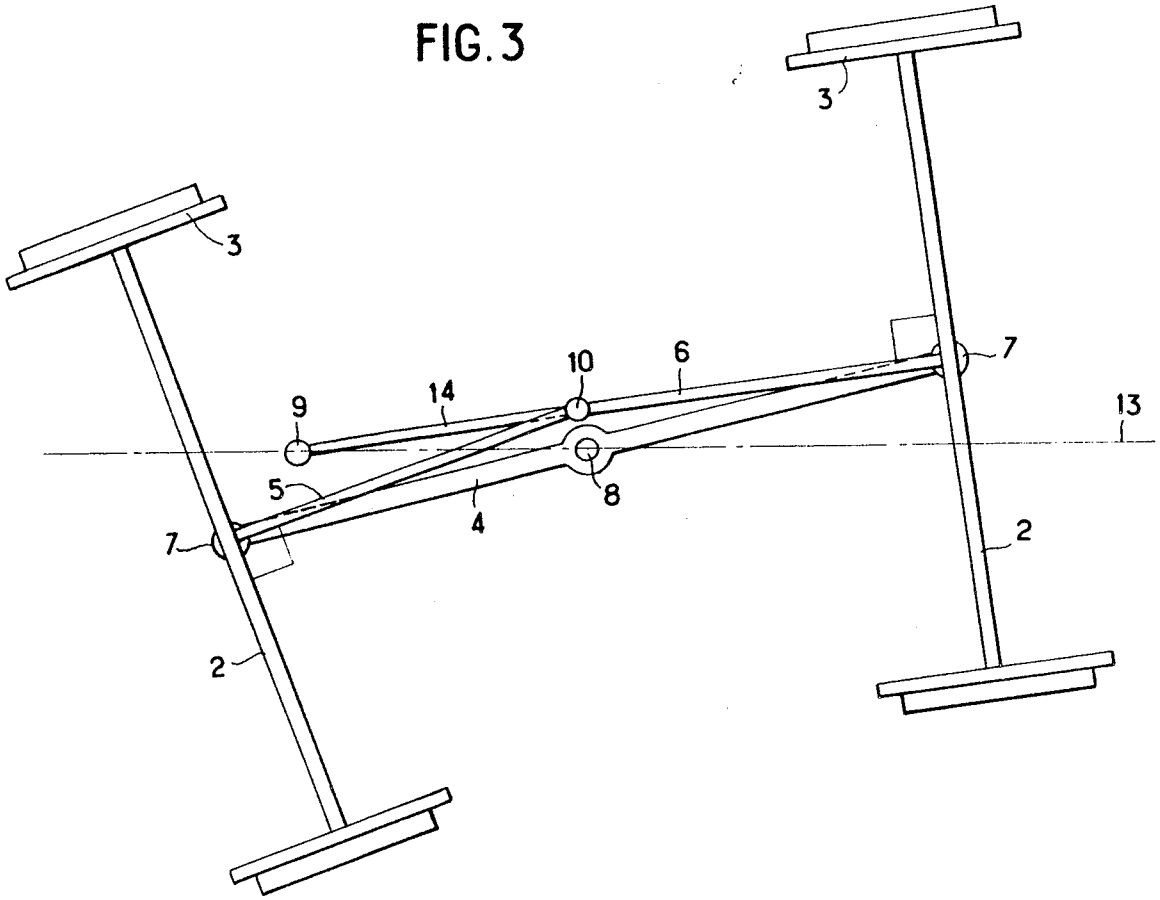
FIG. 3 is a diagrammatic plan view of a detail from FIG. 2.

As shown in FIGS. 2 and 3, in which the radius of the curve of the rails has been substantially exaggerated in order to show separately the link bar and the two steering bars, because the pivot point 10 moves away from the first vertical axis 8, the link bar 4 and steering bars 5 and 6 open to define a triangle, causing a change in the length of the link bar 4 or of the steering bars 5 and 6. This change in length is very small thus, for example, for a minimum radius of curvature of 30 meters, a distance (a) between the axle sets of 10 meters, a half-distance between axles of the same set (2) equal to 1 meter and an extension length (b) equal to 0.25 meters, the maximum change in length of the steering bars 5 and 6 is $6.10^{-4}$m and the radiality of the two axles is maintained to within $6.10^{-3}$ degrees.

To accommodate the change in length, elastic blocks may be used to connect the steering bars to the axles, or to connect the two ends of the link bar to axles.

To distribute the load of the vehicle better on the four axles, the load is applied to each of the axles at two points disposed adjacent the wheels, so that for each set four support points are provided which are disposed not in the longitudinal median plane 13 as in the case of a bogie, but at the sides of the vehicle, which avoids disadvantages arising from the overhang. The first fixed vertical pivot axis 8 then bears no load and only ensures the guidance of each set without any vertical thrust; this also applies to the second vertical pivot axis 9.

The connection between the body 1 and the four axles 2 is achieved using elements having a small friction coefficient; side friction blocks of a known type may be used.

In a variant embodiment, the load of the railway vehicle is applied to each axle at two points close to the wheels through torsion springs.

Figure 4:
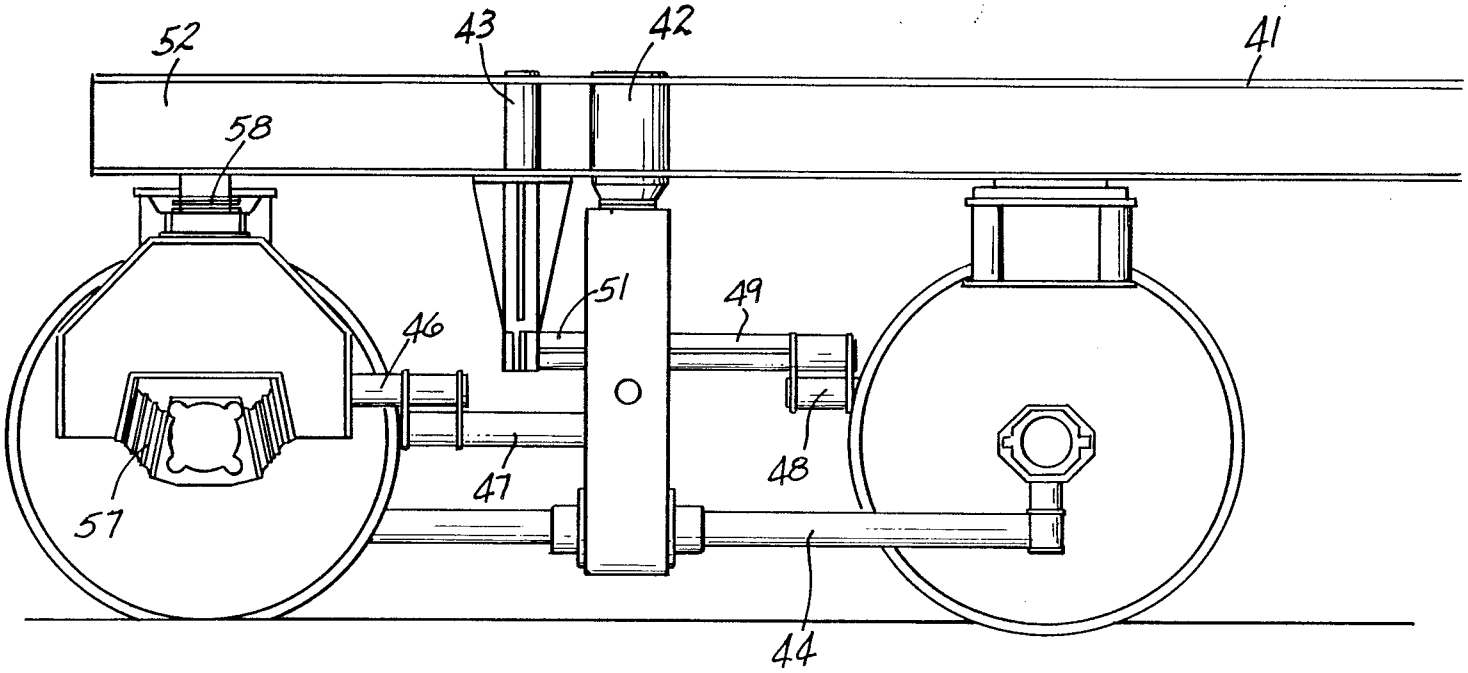
FIG. 4 is a side view of an embodiment of a set of two radially guided axles according to the invention.
Figure 5:
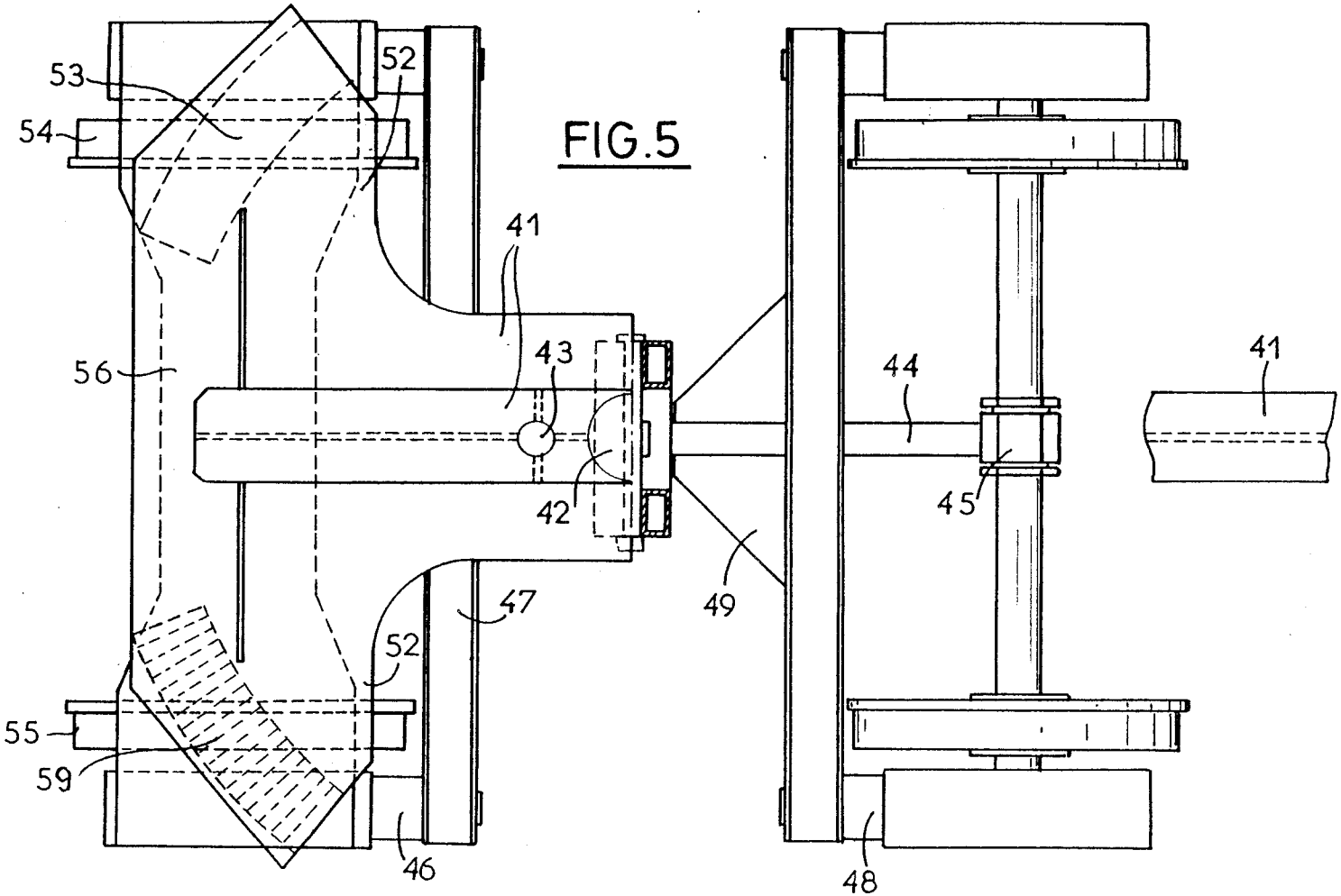
FIG. 5 is a top view of the embodiment of FIG. 4.

FIGS. 4 and 5 show an embodiment of the invention and represent a set of two radially guided axles as disclosed hereabove. FIG. 5 is a top view on which the load distribution elements are only represented on the right part for clarity purposes and FIG. 4 is a side view in which the left wheel is seen from the outside and the right wheel is seen from the inside.

The vehicle body is schematized by a part 41 on which a central pivot 42 corresponding to the first vertical axis 8 is fixed; the part 41 supports also a vertical rotation axle 43 that corresponds to the second fixed vertical axis 9.

A horizontal bar 44 is linked at its both ends to the center 45 of each axle ; the center of this bar 44 is articulated on the central pivot 42. This horizontal bar 44 corresponds to the horizontal link bar 4 disclosed.

The steering bars of each axle are constituted by two bars 46 (respectively 48) that are secured to the ends of the axle and connected to a part 47 (respectively 49).

These two parts 47 and 49 are linked together about a central vertical axis (not visible on the figures) corresponding to the pivot point 10. One of these parts, the part 49 in the shown embodiment, comprises an extension 51 projecting beyond the central pivot point; the free end of this extension 51 is linked about the pivot 43 constituting the second fixed vertical axis.

According to the invention, the load of the body is distributed on both axles of each two-axle set in the vicinity of the wheels. As shown in particular on FIG. 5, one end of the body that is represented by a piece 41 comprises two arms 52 in the vicinity of each wheel 54 and 55. These arms are used for transferring the load to the body of each axle of each two-axle set. Taking into account the relative movement of the body and the axles, this, transfer of load is advantageously realized through moving means, such as side friction blocks 53 that are integral with the cross-member 56. The side friction blocks are friction parts that are commonly used in the railway technique for receiving one part of the body and transferring it to the cross-member. Due to the use of such side friction blocks, it is possible to realize a load transfer while permitting any movement of the two parts that are resting one on the other.

Instead of side friction blocks, it is also possible to use torsion springs 58 that also allow the absorption of the relative displacement of the body and the axles; the use of such torsion springs realizes a suspension system; in that case, the primary suspensions 57 that are shown on each wheel on FIG. 4 can be cancelled.

It is also possible to use roller races 59 or ball races instead of the side friction blocks for transmitting the load of the body. The use of such races has the advantage that they have a lower braking torque than that side friction blocks.

The invention thus enables the load to be distributed better and also to eliminate the beams used in a bogie which transmit the load from the center of the bogie to the axles this simplifies the design of the axle sets compared to the bogie and a reduction is obtained in the weight of the structure of the axle sets. The distribution of the loads on four points limits the sway movement.

Compared to vehicles comprising two radial axles of the kind described above, these embodiments of the invention enable, the load of the vehicle practically to be doubled for the same axle loading; thus, for example, if the acceptable load is 22.5 tons per axle, it is possible to produce heavy railway vehicles.

Another advantage of the invention is a reduction in the degree of unloading in the stands of banking; that is to say, that in the entry to curves with banking, no wheel is unloaded, since the two axles are independent.

Furthermore, the four frictions points of the body on each two-axle set limit sway movements.

We claim:

1. A railway vehicle comprising a body having a first set of two spaced apart axles and a second set of two spaced apart axles, each of said first set and said second set comprises: a horizontal link bar extending between said two spaced apart axles and pivotally fixed at its opposite ends to each of said axles at substantially the midpoint thereof, said horizontal link bar being pivotable about a first vertical axis defined by a member fixed to said body at a point midway between the midpoints of said axles; a first steering bar and a second steering bar, said first steering bar having one end secured orthogonally to one of said axles at substantially the midpoint thereof and the other end pivotably fixed to a second vertical axis fixed to said body at a point beyond the midway point between the midpoints of said axles and said second steering bar having one end secured orthogonally to the other of said axles at substantially the midpoint thereof and the other end pivotably mounted to said first steering bar at a point equidistant from said axles and means for directly applying the load of the body to each wheel axle in the vertical plane of each axle and at two points adjacent to the wheels connected to each axle.

2. A railway vehicle as claimed in claim 1 wherein the second vertical axes are disposed closer to the ends of the vehicle than the first vertical axes.

3. A railway vehicle as claimed in claim 1 wherein the distance (a) separating the first vertical axes of rotation, the length (n) of the first steering bars beyond the midway point and the half-distance (b) between the two axles of the same set when the vehicle is on a straight track being related at least approximately by the equation:

$$n = \frac{2b^2}{a - 2b}.$$

4. A railway vehicle as claimed in claim 1, wherein the load of the body is applied through moving means.

* * * * *